US008016551B2

(12) United States Patent
Lin

(10) Patent No.: US 8,016,551 B2
(45) Date of Patent: Sep. 13, 2011

(54) REVERSE CURVED NOZZLE FOR RADIAL INFLOW TURBINES

(75) Inventor: Frank F. Lin, Torrance, CA (US)

(73) Assignee: Honeywell International, Inc., Morristown, NJ (US)

( * ) Notice: Subject to any disclaimer, the term of this patent is extended or adjusted under 35 U.S.C. 154(b) by 1318 days.

(21) Appl. No.: 11/266,934

(22) Filed: Nov. 3, 2005

(65) Prior Publication Data

US 2009/0324399 A1 Dec. 31, 2009

(51) Int. Cl.
*F01D 17/16* (2006.01)

(52) U.S. Cl. ..... 415/163; 415/164

(58) Field of Classification Search ..... 415/159–165; 416/185, 186 R, 186 A, 214 R
See application file for complete search history.

(56) References Cited

U.S. PATENT DOCUMENTS

| | | | | | |
|---|---|---|---|---|---|
| 2,518,660 | A * | 8/1950 | Browne | 415/122.1 |
| 2,971,333 | A * | 2/1961 | Mendelsohn et al. | 415/163 |
| 3,350,061 | A * | 10/1967 | Strass | 415/159 |
| 3,957,392 | A * | 5/1976 | Blackburn | 415/161 |
| 4,804,316 | A * | 2/1989 | Fleury | 415/164 |
| 4,968,216 | A * | 11/1990 | Anderson et al. | 415/199.5 |
| 5,092,126 | A * | 3/1992 | Yano | 415/164 |
| 5,299,909 | A | 4/1994 | Wulf | |
| 6,419,464 | B1 * | 7/2002 | Arnold | 415/160 |
| 6,491,493 | B1 | 12/2002 | Watanabe et al. | |
| 6,709,232 | B1 | 3/2004 | Vogiatzis | |
| 6,776,582 | B2 | 8/2004 | Segawa et al. | |
| 6,887,041 | B2 | 5/2005 | Coke et al. | |
| 6,968,702 | B2 * | 11/2005 | Child et al. | 415/159 |
| 7,255,530 | B2 * | 8/2007 | Vogiatzis et al. | 415/159 |

* cited by examiner

*Primary Examiner* — Christopher Verdier
(74) *Attorney, Agent, or Firm* — Oral Caglar, Esq.

(57) ABSTRACT

A nozzle for radial inflow turbines having an outer surface having a concave shape, and an inner surface having a non-concave, i.e. straight or convex, shape. Also a leading edge may have a hole that is capable of receiving a fastener to secure the nozzle vane to an assembly housing.

9 Claims, 5 Drawing Sheets

REVERSE CURVED NOZZLE FOR RADIAL INFLOW TURBINES

GOVERNMENT RIGHTS

This invention was made with Government support under contract number N00019-02-C-3002 awarded by the United States Department of Defense. The Government has certain rights in this invention.

BACKGROUND OF THE INVENTION

This invention relates to a nozzle vane of a radial inflow turbine, and more particularly to a reverse curved nozzle vane.

Typically, the nozzle vane of a radial inflow turbine for an Air Cycle Machine (ACM) has an airfoil shape formed by a concave inner surface, also referred to as the pressure surface; and either a convex or flat outer surface, also referred to as the suction surface. These nozzle vanes usually require brazing or welding between the nozzle and the housing assembly. Sometimes, rather than brazing or welding, mounting bolts may be used, which may reduce assembly cost, and may provide for increased or more secure containment. Containment is a special structure requirement for most of the aircraft applications, i.e., when a wheel breaks due to overspeed in any adverse circumstances, all the broken parts with high kinetic energy need to be contained in a housing structure. However, a nozzle vane head (also called the leading edge) that uses mounting bolts is usually larger than a nozzle vane head using brazing or welding. And, a larger head may lead to excessive aerodynamic losses.

A main function of the turbine nozzle is to convert the flow static head to dynamic head by accelerating the flow in both the radial direction and the tangential direction. Static head is an expression for the energy of the fluid per unit mass due to the fluid static pressure difference between two reference points. The dynamic head, also referred to as the "velocity head", is proportional to the square of the velocity of the working fluid. The sum of the above two heads usually refers to the total head, provided both reference points, the inlet and exit of a pipe, or a nozzle, or a turbine, are at the same elevation. For an ideal flow through a nozzle, the total head would be constant, even though the static head and the dynamic head would change over the length of the nozzle. But in reality, total head decreases along the flow path inside the nozzle due to wall friction, boundary layer growth, and boundary layer separation.

Aerodynamic losses incurred in the above conversion process are also due to incidence when flow enters nozzle vane passage at an angle. For a well-designed airfoil-shaped nozzle vane with a thin leading edge, the main aerodynamic loss may be from vane surface friction. However, when the large rounded leading edge required by mounting bolts is present with a traditional wedge-type nozzle vane (as seen in prior art FIG. 1) or a traditional inward-concave/outward-non-concave vane profile (as seen in prior art FIGS. 2 and 3), the loss from the boundary layer separation may be predominant even at the design condition due to immediate flow over-turn after the large leading edge.

U.S. Pat. No. 5,299,909 discloses a radial turbine nozzle vane that has a pressure surface (inner surface) having a concave inwardly portion after the nozzle throat, and the convex outwardly shape at its suction surface (outer surface), as seen in FIG. 2 of the '909 patent.

U.S. Pat. No. 6,491,493 discloses an axial flow turbine, as opposed to a radial inflow turbine. The '493 patent discloses a preferred width of nozzle blades, and the spacing between nozzle blades, as seen in the '493 patent FIGS. 1 and 2.

U.S. Pat. No. 6,887,041 discloses axial flow turbines for gas turbine engines, and all the nozzle vanes have a conventional airfoil shape. The '041 patent discloses a particular airfoil-shaped vane profile by x-y-z coordinates as seen in Table 1.

As discussed above, each of these patents would have the disadvantages of excessive aerodynamic loss due to incidence and boundary layer separation if an large leading edge is introduced to accommodate the mounting hole for low-cost assembly and enhanced containment reasons.

FIG. 1 illustrates a prior art wedged nozzle vane 10. This prior art wedged nozzle vane 10 has a straight outer surface 11 and a straight inner surface 12. This type of design can be made at a lower cost but has excessive aerodynamic loss due to the unfavorable flow acceleration schedule inside the nozzle flow passage.

FIG. 2 illustrates a prior art semi-airfoil nozzle vane 20. This prior art semi-airfoil nozzle vane 20 has a straight outer surface 21 and a concave inner surface 22. This type of design can accommodate mounting bolts at its large leading edge but will result in excessive aerodynamic loss due to the immediate flow over-turn right after the leading edge.

FIG. 3 illustrates an airfoil nozzle vane 30. This prior art airfoil nozzle vane 30 has a convex outer surface 31, and a concave inner surface 32. This type of design can have reduced aerodynamic loss, but usually does not permit the use of mounting holes due to the vane thickness and radial constraint.

As can be seen, there is a need for a nozzle vane that does not lead to excessive aerodynamic losses, that has improved containment features, and has reduced assembly cost.

SUMMARY OF THE INVENTION

According to one aspect of the present invention, a radial inflow turbine nozzle comprises a body having a leading edge, a trailing edge, an outer surface, and an inner surface; the outer surface extending from the leading edge to the trailing edge, and the outer surface having a concave shape; and the inner surface extending from the leading edge to the trailing edge, and the inner surface having a non-concave shape.

According to another aspect of the present invention, a nozzle vane for radial inflow turbines comprises a body having a leading edge, a trailing edge, an outer surface, and an opposed inner surface; a hole through the body near the leading edge capable to receive a fastener to secure the nozzle vane to a housing assembly; the trailing edge disposed radially inwardly and downstream with respect to the leading edge; the outer surface extending from the leading edge to the trailing edge, and the outer surface having a concave shape; and the opposed inner surface extending from the leading edge to the trailing edge, and the inner surface having a non-concave shape.

According to a further aspect of the present invention a nozzle vane configuration for a housing assembly of a radial inflow turbine for an air cycle machine comprises a plurality of nozzle vanes disposed substantially equidistant from a center point of a circle; each of the nozzle vanes having body having a leading edge, a trailing edge, an outer surface, and an inner surface; the leading edge having a portion that is disposed equidistant from the center point; the trailing edge having a portion that is disposed equidistant from the center point, the trailing edge disposed closer to the center point than the leading edge; a hole through the body near the leading edge capable of receiving a fastener to secure at least one nozzle vane to a housing assembly; the trailing edge disposed downstream with respect to the leading edge; the outer surface extending from the leading edge to the trailing edge, and the outer surface having a concave shape; and the inner surface extending from the leading edge to the trailing edge, the inner surface having a non-concave shape.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Briefly, the present invention provides a nozzle vane having a new and useful shape, specifically the shape of its outer surface and its inner surface. This invention may be used for turbines. More specifically, the present invention may be used for radial inflow turbines for aircraft and Air Cycle Machines. The nozzle vane of the present invention may have an outer surface with a concave configuration, and an inner surface with a non-concave configuration i.e., such as a straight shape or a convex shape. Also, a leading edge of the body may have a hole that is capable of receiving a fastener to secure the nozzle vane to an assembly housing. This structure differs from the prior art above in that such prior art does not disclose a nozzle vane that has a concave outer surface coupled with a straight or convex inner surface.

Figure 1:
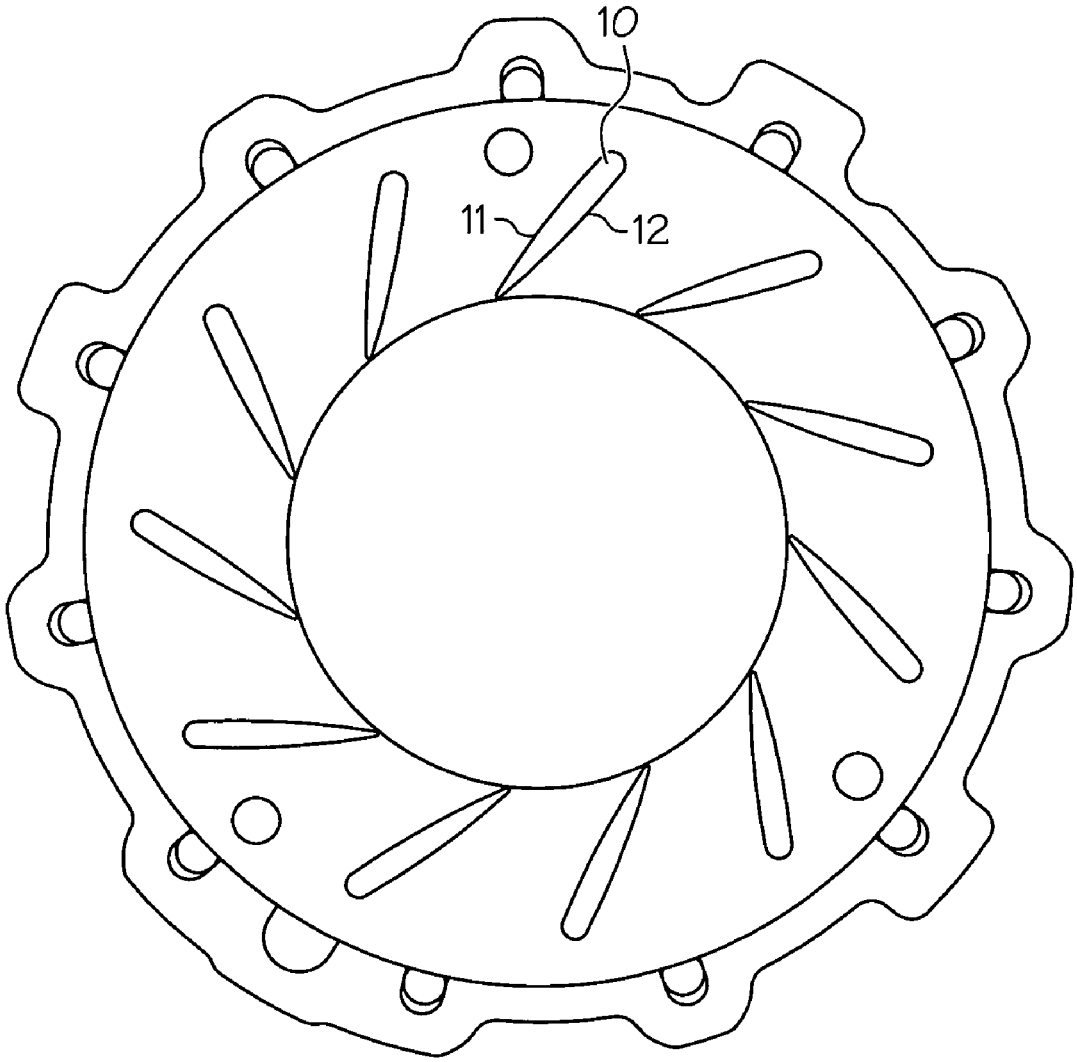
FIG. 1 (PRIOR ART)
FIG. 1 shows a profile of a prior art nozzle vane.
Figure 2:
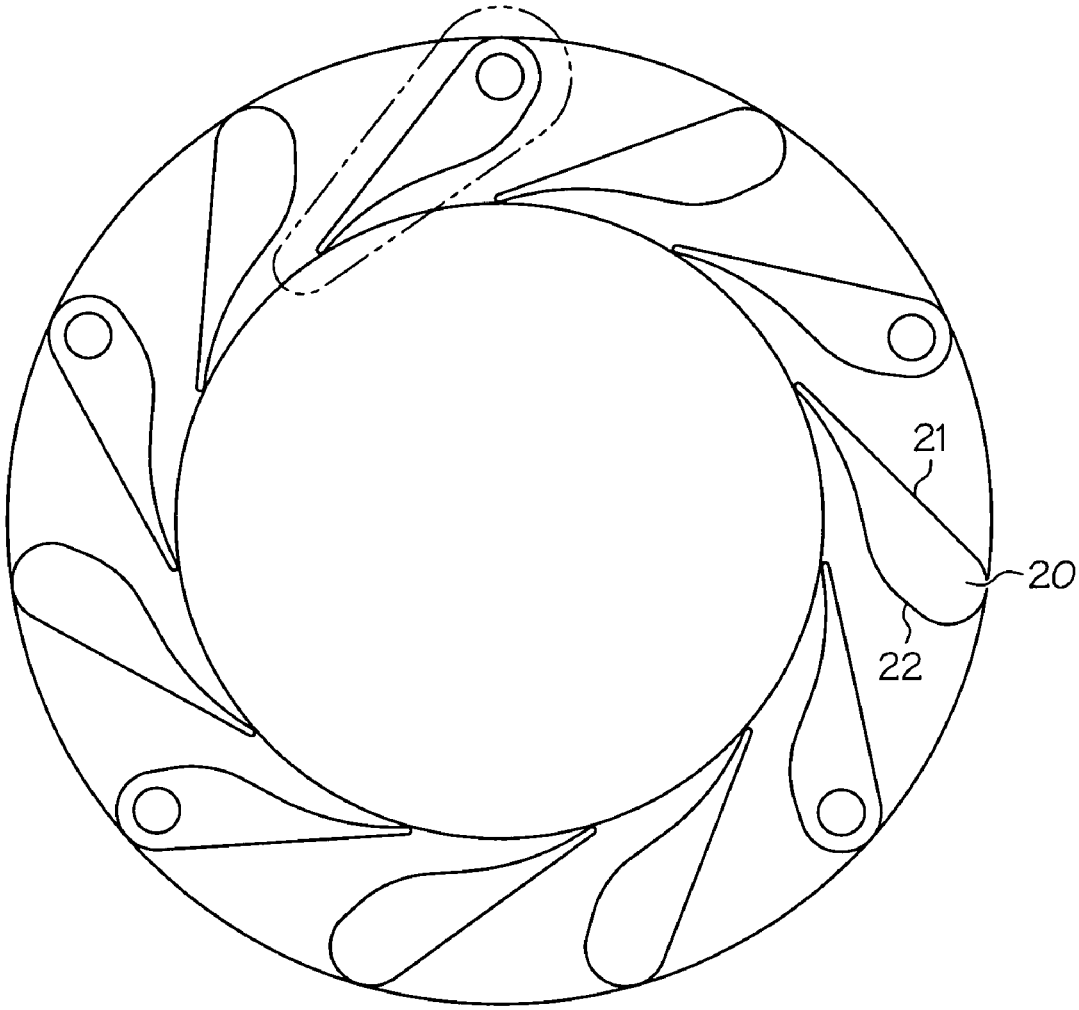
FIG. 2 (PRIOR ART)
FIG. 2 discloses a profile of a second prior art nozzle vane.
Figure 3:
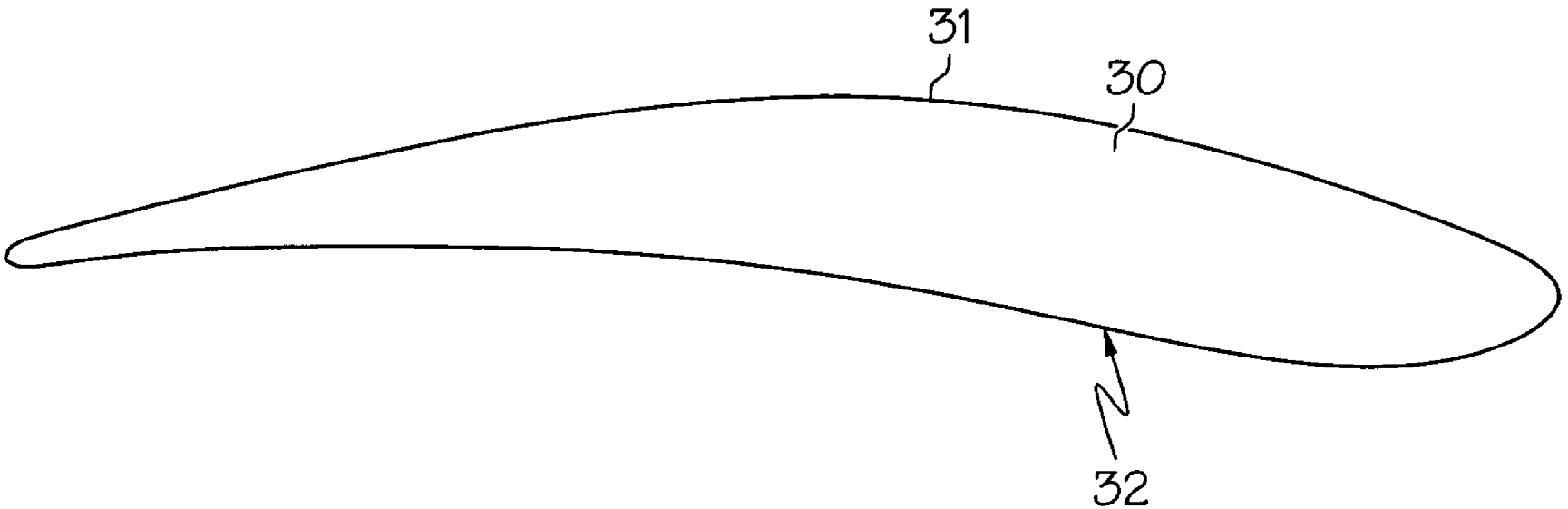
FIG. 3 (PRIOR ART)
FIG. 3 discloses a profile of a third prior art nozzle vane.
Figure 4:
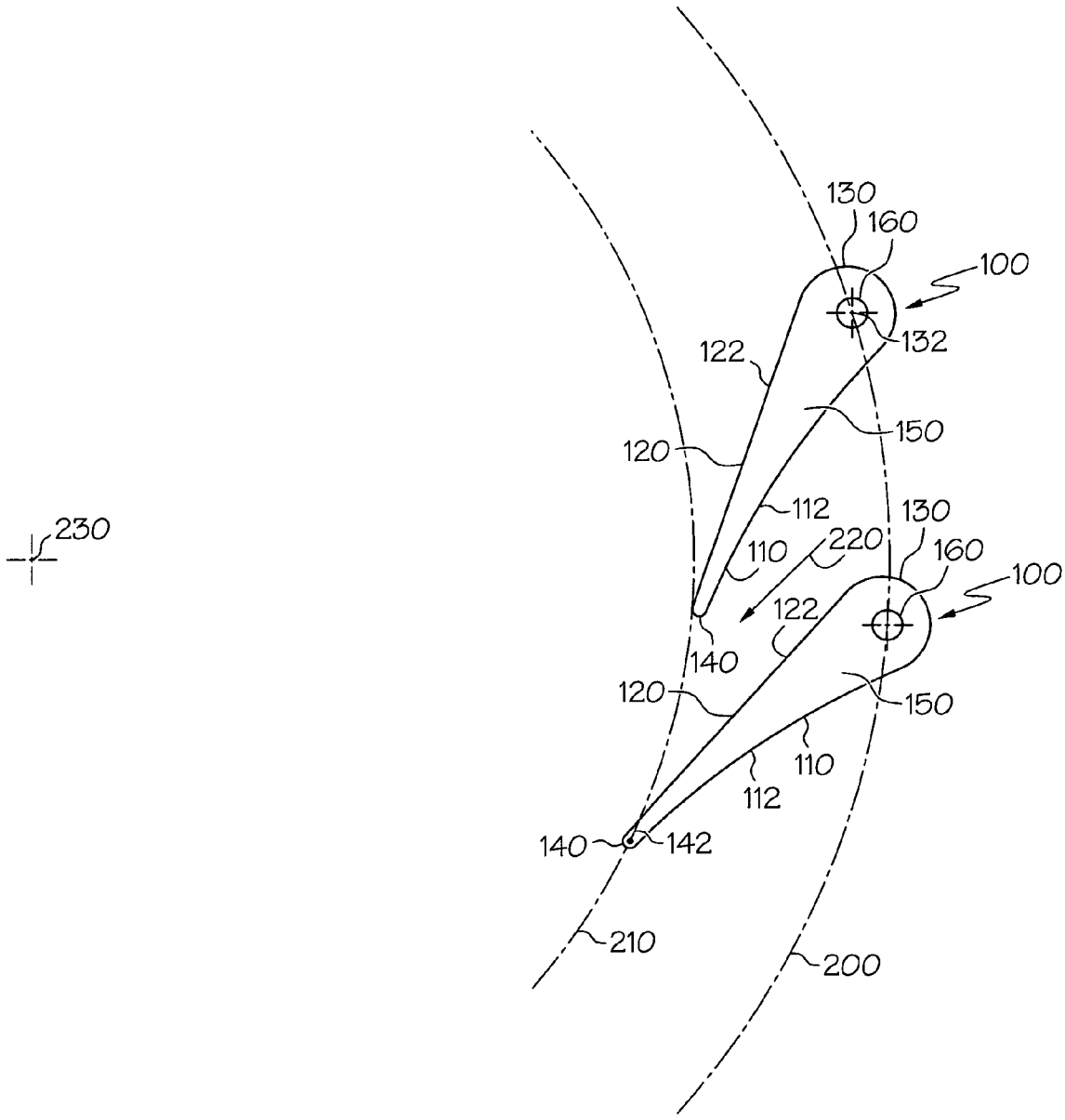
FIG. 4 shows a vane profile of an embodiment of the present invention.

FIG. 4 illustrates an exemplary embodiment of a nozzle vane 100 of the present invention. The nozzle vane 100 may have a body 150 having an outer surface 110 and an inner surface 120. The outer surface 110 may be described as being opposed to the inner surface 120. The nozzle vane 100 may also have a leading edge 130 and a trailing edge 140. As illustrated in FIG. 4, the outer surface 110 may have a concave shape 112, and the inner surface 120 may have a non-concave shape, such as a linear or straight shape 122. In one exemplary embodiment of the present invention, a mounting hole or hole 160 may be disposed through a portion of the leading edge 130 to mount the nozzle vane 100 to an assembly housing (not shown).

Figure 5:
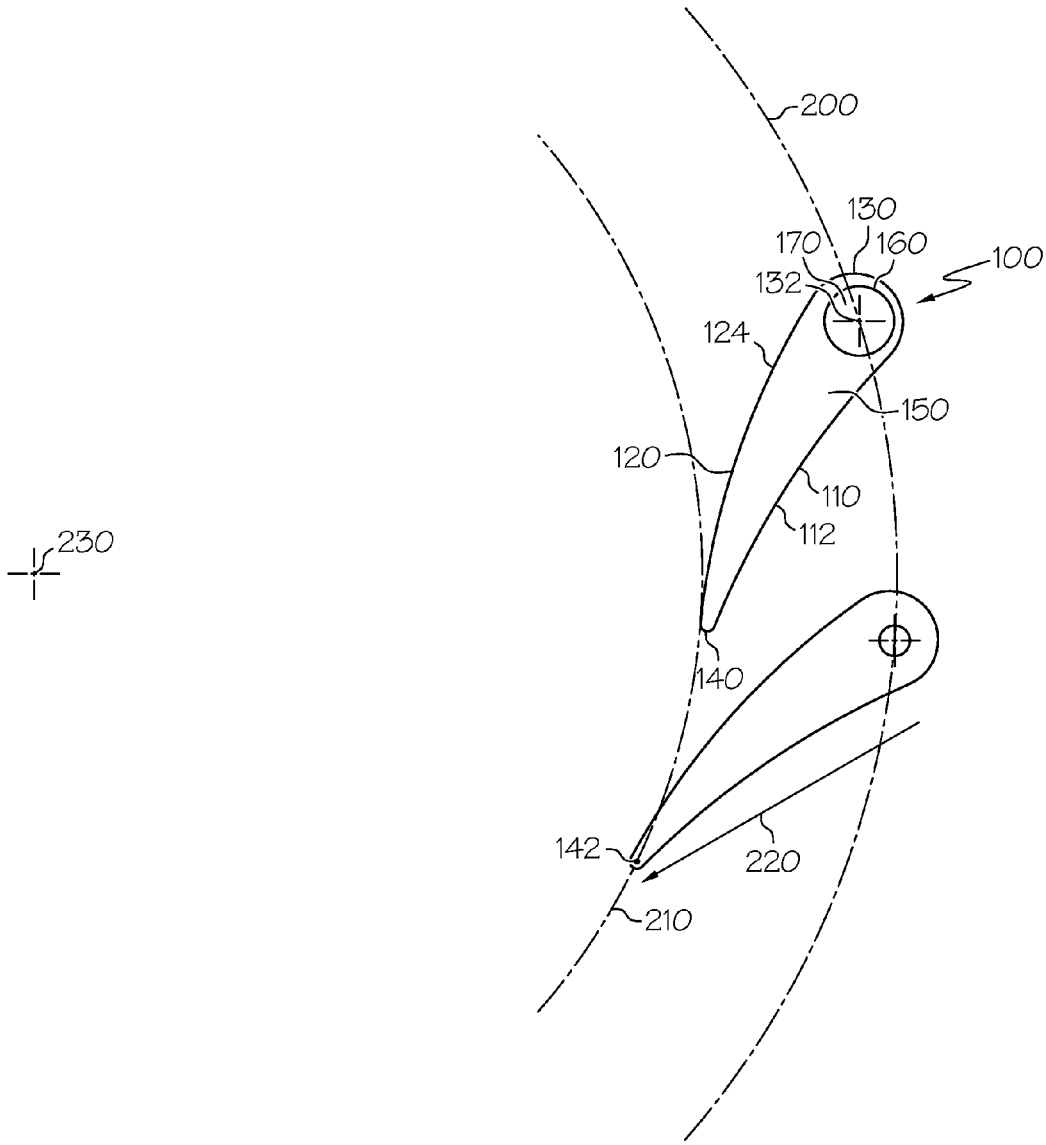
FIG. 5 shows a vane profile of another embodiment of the present invention.

FIG. 5 illustrates another exemplary embodiment of the invention whereby the outer surface 110 of the nozzle vane 100 may have a concave shape 112, and the inner surface 120 may have a convex shape 124.

As a result of the curvature shapes of the exemplary embodiments of the present invention as illustrated in FIGS. 4 and 5, the flow turning schedule (air turbulence adjacent to the nozzle vane 100) may be shifted downstream, and the adverse over-turn of the flow right after the leading edge 130 can be avoided. In other words, air friction downstream 220 from the leading edge may be reduced, and air turbulence that is adjacent to the vane 100. Consequently the boundary layer separation, which may be located at the trailing edge, can be suppressed or delayed and the aerodynamic loss due to this boundary layer separation may be reduced.

Otherwise, as in the prior art, the boundary layer separation at the surface of a nozzle vane may cause localized regions of very high unsteadiness. This unsteadiness may cause increased friction and resistance.

In the exemplary embodiments as illustrated in FIGS. 4 and 5, the body 150 may have a leading edge 130 and a trailing edge 140. The outer surface 110 extends from the leading edge 130 to a trailing edge 140. The inner surface 120, 122, 124 extends from the leading edge 130 to the trailing edge 140.

The leading edge 130 and trailing edge 140 may have a circular or elliptical shape, the body 150 may have an outer surface 110 and an inner surface 120 with prescribed curvatures. The vane profile of the nozzle vane 100 as illustrated in FIGS. 4 and 5 may be a continuous loop with its constituent curves tangent to each other.

For radial inflow turbines, the leading edge 130 may have a center point 132 disposed at the perimeter on a first circle 200, and the trailing edge 140 may have a center point 142 disposed at the perimeter of a second circle 210 that may be concentric with the first circle 200. Thus, the trailing edge 140 is located radially inwardly with respect from the leading edge 130. The angular positions of the leading edge 130 and trailing edge 140 may be offset to achieve a prescribed overall flow turning. In an exemplary embodiment of the present invention, the trailing edge 140 is offset with respect to the leading edge 130. In other words, the trailing edge 140 is disposed downstream from the leading edge 130.

The maximum thickness of the body 150 may occur at the leading edge 130 portion of the body 150, where a hole 160 may be disposed therethrough to allow a fastener, such as a bolt 170, to secure the nozzle vane 100 to a housing assembly (not shown).

In a further exemplary embodiment of the present invention, a plurality of nozzle vanes 100 may be disposed substantially equidistant from a center point 230 of a first circle 200 and a second circle 210. The nozzle vanes may be oriented in such a way that the leading edge 130 may have a portion that is equidistant from the center point 230, and the trailing edge 140 may have a portion that is equidistant from the center point.

A further exemplary embodiment of the present invention is a nozzle vane configuration for a housing assembly of a radial inflow turbine for an air cycle machine having a plurality of nozzle vanes 100 disposed substantially equidistant from a center point of a first circle 200 and a second circle 210. The nozzle vane 100 shape and body 150 may have the shapes as described above. The leading edge 130 may have a portion that is disposed equidistant from the center point 230 of the first circle 200. The trailing edge 140 may have a portion that is disposed equidistant from the center point 230 of a second circle 210.

It should be understood, of course, that the foregoing relates to exemplary embodiments of the invention and that modifications may be made without departing from the spirit and scope of the invention as set forth in the following claims.

I claim:

1. A radial inflow turbine nozzle housing assembly, comprising:

a plurality of first and a plurality of second nozzle vanes disposed circumferentially around a center point, each of the first and second nozzle vanes including:

a body having a leading edge, a trailing edge, an outer a surface, and an inner surface; and an attachment point positioned on a perimeter of a circle circumscribed around the center point, the outer surface being positioned further from the center point than the inner surface, said outer surface extending from said leading edge to said trailing edge, said outer surface having a concave shape, said inner surface extending from said leading edge to said trailing edge, said inner surface having a non-concave shape, wherein each of the first vanes is held in position with a first bolt passing through the first vane, wherein the first bolt is large enough to provide containment for broken parts if a wheel breaks due to overspeed in adverse circumstances, and wherein each of the second vanes is held in position with a second bolt having a diameter smaller than a diameter of the first bolt.

2. The nozzle housing assembly of claim 1, wherein said inner surfaces of the vanes have a convex shape.

3. The nozzle housing assembly of claim 1, wherein said leading edges have cross-sectional thicknesses larger than cross-sectional thicknesses of said trailing edges.

4. The nozzle housing assembly of claim 1, wherein:

said leading edges capable of being secured to the housing assembly wherein a portion of each of said leading edges is disposed about a perimeter of a first circle concentric with the center point, and a portion of said trailing edge is disposed about a perimeter of a second circle, and said second circle is concentric with said first circle, and said second circle has a diameter smaller than a diameter of said first circle.

5. The nozzle housing assembly of claim 1, wherein said trailing edges are offset with respect to said leading edges.

6. A radial inflow turbine, comprising:

A plurality of first nozzle vanes and a plurality of second nozzle vanes wherein each of the first and the second nozzle vanes includes a body having a leading edge, a trailing edge, an outer surface, and an opposed inner surface, said first and second nozzle vanes being disposed on a perimeter on a circle concentric with a center point, said trailing edge being disposed radially inwardly and downstream with respect to said leading edge, said outer surface extending from said leading edge to said trailing edge, and said outer surface having a concave shape, said opposed inner surface extending from said leading edge to said trailing edge, and having a non-concave shape, the first and second nozzle vanes being positioned circumferentially around the center point so that their outer surfaces are farther from the center point than are their inner surfaces, each of the first vanes having a first hole through said body capable of receiving a first fastener large enough to provide containment for broken parts if a wheel breaks due to overspeed in adverse circumstances, and each of the second vanes having a second hole through said body capable of receiving a second fastener with a diameter smaller than that of the first fastener.

7. The radial inflow turbine of claim 6, wherein said leading edges have a circular shape.

8. The radial inflow turbine of claim 6, wherein said leading edges have an elliptical shape.

9. The radial inflow turbine of claim 6, wherein said leading edges have cross-sectional thicknesses larger than cross-sectional thicknesses of said trailing edges.

* * * * *